US006244615B1

(12) United States Patent
Mendoza et al.

(10) Patent No.: US 6,244,615 B1
(45) Date of Patent: Jun. 12, 2001

(54) INDIVIDUAL SNOWBOARD FOR EACH FOOT

(76) Inventors: Valetta M. Mendoza; Albert Mendoza, both of 1243 12th St., #2, Santa Monica, CA (US) 90401

( * ) Notice: Subject to any disclaimer, the term of this patent is extended or adjusted under 35 U.S.C. 154(b) by 0 days.

(21) Appl. No.: 09/352,305

(22) Filed: Jul. 12, 1999

(51) Int. Cl.[7] ..... A63C 5/00

(52) U.S. Cl. ..... 280/600; 280/601; 280/607; 280/14.21

(58) Field of Search ..... 280/600, 601, 280/602, 607, 608, 609, 610, 14.21

(56) References Cited

U.S. PATENT DOCUMENTS

| | | | | |
|---|---|---|---|---|
| 3,580,596 | * | 5/1971 | Volkl | 280/608 |
| 4,004,355 | * | 1/1977 | Koblick | 280/600 |
| 4,068,861 | * | 1/1978 | Zemke | 280/608 |
| 4,280,715 | * | 7/1981 | Freelander et al. | 280/600 |
| 4,836,571 | * | 6/1989 | Corbisiero | 280/600 |
| 5,393,077 | * | 2/1995 | Wanous | 280/600 |
| 5,398,957 | * | 3/1995 | Leighton et al. | 280/600 |
| 5,687,983 | * | 11/1997 | Feketa et al. | 280/608 |
| 5,720,120 | * | 2/1998 | Smith | 280/600 |

FOREIGN PATENT DOCUMENTS

| | | | | |
|---|---|---|---|---|
| 623652 | * | 8/1961 | (IT) | 280/600 |

* cited by examiner

*Primary Examiner*—Richard M. Camby
(74) *Attorney, Agent, or Firm*—David A. Belasco; Robert Jacobs; Beehler & Pavitt

(57) ABSTRACT

An improved individual snowboard for each foot is described. The invention provides a series of features improving the stability and performance of the snowboards. Each of the individual snowboards includes a turned up nose and tail, a top, a bottom, a resilient core located between the top and bottom, first and second sides and a surrounding right-angle edge. The core is capable of supporting the mounting of a snowboarding boot binding. A variant of the invention includes specially shaped sidecuts on each of the first and second sides. The sidecuts allow improved turning and stoping capability. The edge may also be segmented to increase flexibility of the snowboard for improved turning. In another variant, the upward curve of the nose and tail have specially designed dimensions. A further variant of the invention includes special low-friction base material attached to the bottom of the snowboard inside of the edge perimeter.

8 Claims, 2 Drawing Sheets

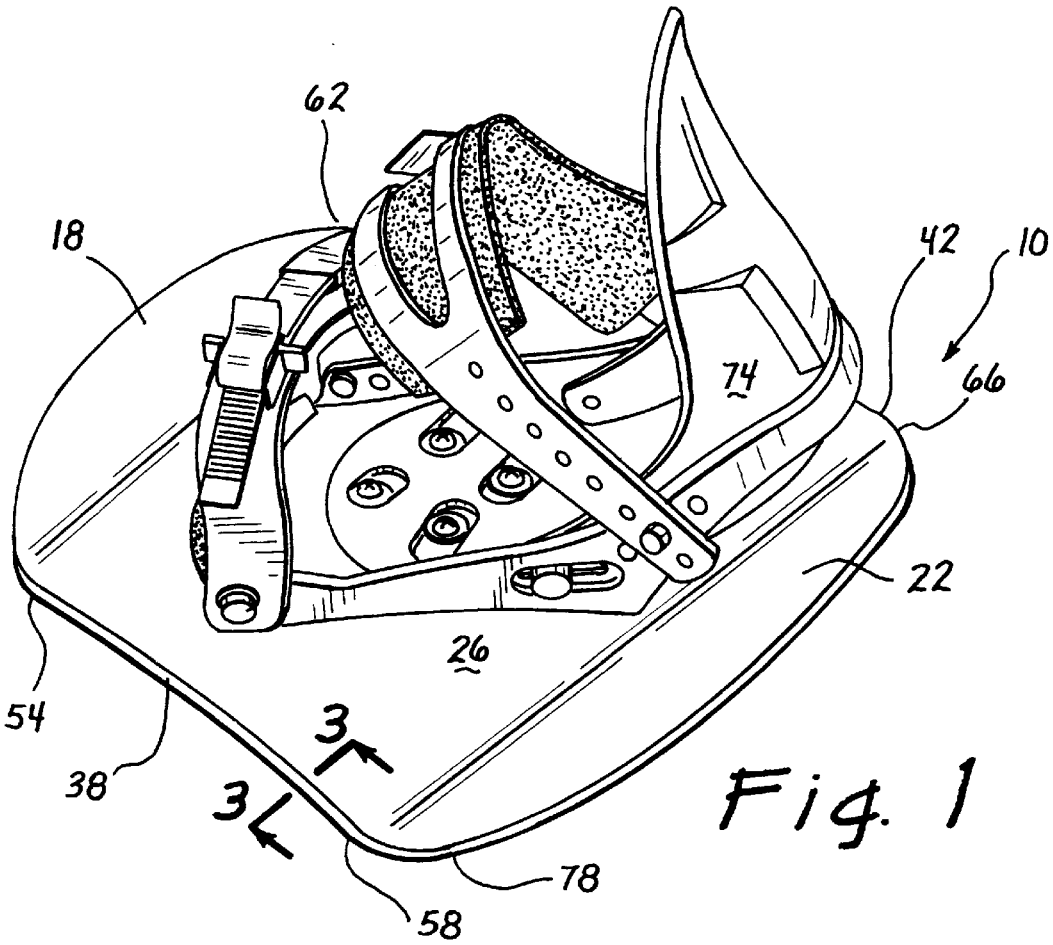
Fig. 1
Fig. 2
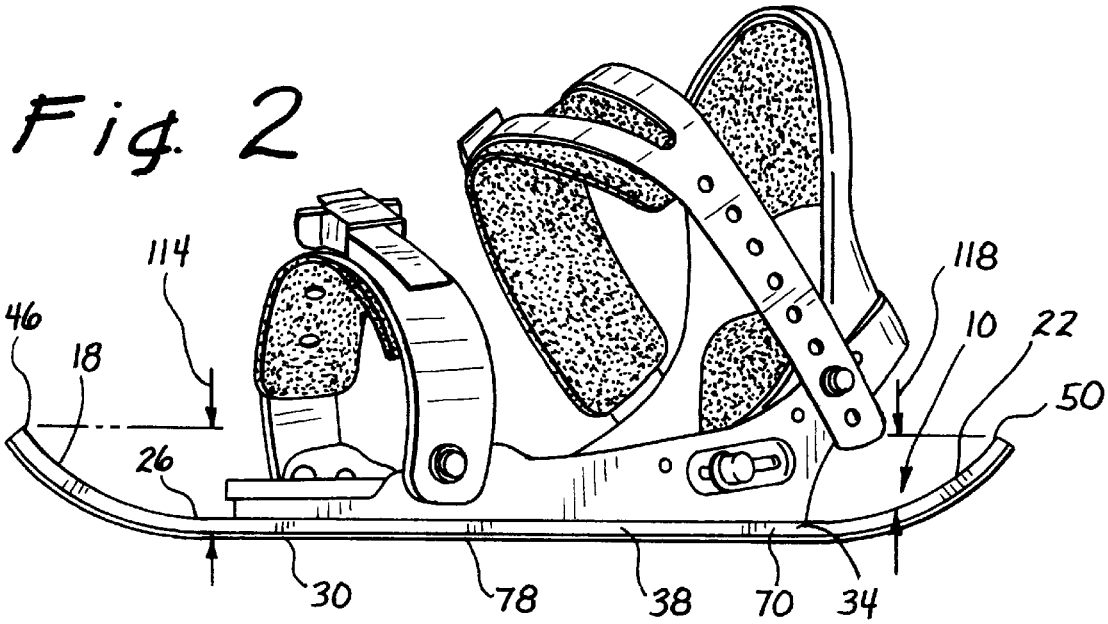

INDIVIDUAL SNOWBOARD FOR EACH FOOT

RELATED PATENT

This application is related to U.S. Pat. No. Des. 383,824 issued Sep. 16, 1997 to the applicant.

FIELD OF INVENTION

The invention pertains to sporting equipment for use on snow-covered surfaces. More particularly, the invention relates to skis and snowboards for use on inclined terrain.

BACKGROUND OF THE INVENTION

Various types of foot-mounted equipment has been developed for travel or sporting use over snow covered surfaces; incorporating a number of different technologies. U.S. Pat. No. 405,516 issued to Watson is directed to a snowshoe incorporating an opening in the snowshoe. The opening permits the foot, which is secured to the snowshoe with a series of three or more transverse leather straps secured at suitable distances apart to the margin of the opening, to gain a slight purchase on the snow as the foot extends slightly through the opening. While this design is effective in permitting the user to travel on flat ground or uphill, it does not allow him to glide easily downhill.

U.S. Pat. No. 5,462,304 issued to Nyman, describes a snowboard with dual-acting interchangeable edges designed to provide increased tracking stability on straight ahead runs and increased carving power in turns. While arguably achieving these objectives, the Nyman design requires that one foot be removed from the snowboard to maneuver on flat ground or to get on to or off of chair lifts.

U.S. Pat. No. 5,286,051, issued to Scherübl, discloses an alpine ski having specific proportions relating to length, width and sidecut for improved control and handling, particularly in deep snow. While the use of such proportions permit improved handling for the ski, the invention does not allow for snowboard-style turning and stopping. U.S. Pat. No. 5,580,078 issued to Vance describes a double edged snowboard having a lower central running surface and a pair of parallel outer running surfaces for use in turning. The three running surfaces are separated by an inner pair of edges and the outer running surfaces are flanked by an outer pair of edges. This snowboard achieves improved handling and stability through the use of its specially adapted running surface and edge system however, it still provides the user with difficulty maneuvering on flat ground and in using chairlifts. Further, this type of snowboard requires a significant investment of time in order for the user to master the skills required for operation of the board.

While other variations exist, the above-described designs for skis, snowshoes and snowboards are typical of those encountered in the prior art. It is an objective of the present invention to provide equipment that allows the user to enjoy the sport of snowboarding with a minimum investment in time to become proficient in its use. It is a further objective to allow the user to maneuver easily on flat ground without the need to remove one foot from the snowboard binding. It is a still further objective of the invention to permit the user to ride chairlift equipment with a minimum of danger and discomfort. It is yet a further objective to provide the user with the capability to easily carve turns and stop on both packed snow surfaces and in deep snow. It is still another objective of the invention to provide the above-described capabilities in inexpensive and durable snowboards that are adaptable for use with standard snowboard boots and bindings.

While some of the objectives of the present invention are disclosed in the prior art, none of the inventions found include all of the requirements identified.

SUMMARY OF THE INVENTION

The present invention addresses all of the deficiencies of prior skis and snowboards and satisfies all of the objectives described above.

An improved individual snowboard for each foot providing the desired features may be constructed from the following components. A curved up front shovel, a curved up tail, a top, a bottom, a core and first and second sides are provided. The core is located between the top and the bottom. The shovel and the tail each have an end, an inner side and an outer side. The first side extends from the inner side of the shovel to the inner side of the tail. The second side extends from the outer side of the shovel to the outer side of the tail.

The core is formed of resilient material capable of providing rigidity to the snowboard and securing mounting of a snowboard boot binding. An edge is provided. The edge is formed as a substantially right angle at an intersection of the bottom and each of the front shovel, first and second sides, and the tail.

A variant of the invention further includes first and second sidecuts. The first sidecut is formed as an inward deflection of the first side from a line extending from the inner side of the shovel to the inner side of the tail. The second sidecut is formed as an inward deflection of the second side from a line extending from the outer side of the shovel to the outer side of the tail.

In another variant of the invention, the inward deflection of the first sidecut is in the range of 0.125 inches to 0.25 inches and the inward deflection of the second sidecut is in the range of 0.125 inches to 0.25 inches.

In still another variant, a displacement of the end of the shovel above the top of the snowboard is in the range of one inch to four inches and a displacement of the end of the tail above the top of the snowboard is in the range of one inch to four inches.

In yet another variant of the invention, the edge further includes inset, resilient, hardened material surrounding a perimeter of the snowboard adjacent the bottom. The inset material is capable of being sharpened and holding an edge.

In still a further variant, the edge is segmented at predetermined intervals to provide increased flexibility of the snowboard. In yet a further variant of the invention, low-friction base material is attached to the bottom of the snowboard within an inner perimeter of the inset edge material.

In a final variant of the invention, the low-friction base material is selected from the group containing: urethane plastic, polyurethane and ABS.

DESCRIPTION OF THE DRAWINGS

FIG. 1 is a perspective view of the preferred embodiment of the invention including an attached snowboard boot binding;

FIG. 2 is a side elevation of the FIG. 1 embodiment;

DETAILED DESCRIPTION OF THE PREFERRED EMBODIMENT

Figure 3:
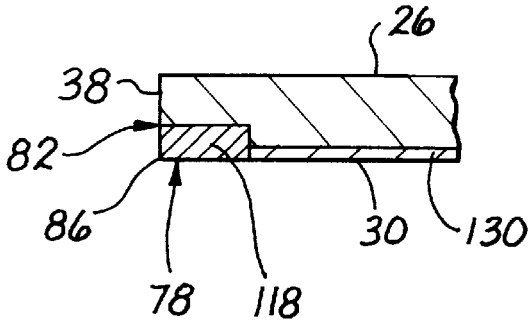
FIG. 3 is a partial cross-sectional view of the FIG. 1 embodiment taken along the line 3—3.
Figure 4:
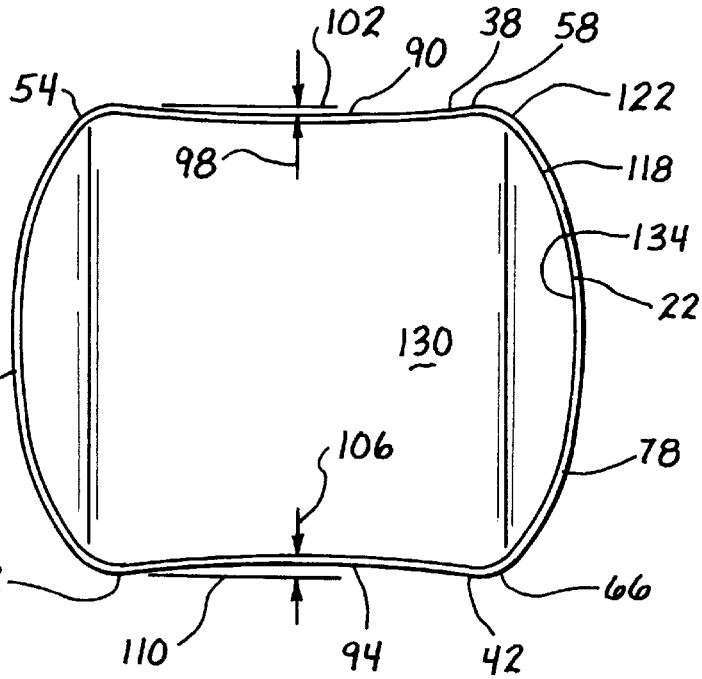
FIG. 4 is a bottom plan view of the FIG. 1 embodiment illustrating a minimum sidecut.
Figure 5:
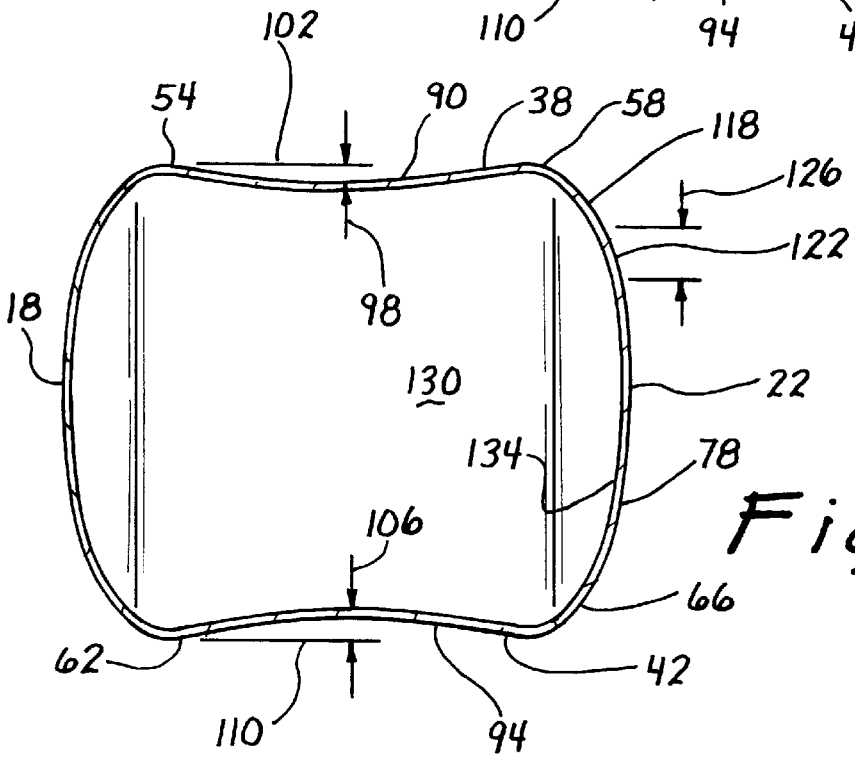
FIG. 5 is a bottom plan view of the FIG. 1 embodiment illustrating a maximum sidecut and a segmented edge.

As illustrated in FIGS. 1–5 an improved individual snowboard 10 for each foot providing the desired features may be constructed from the following components. A curved up front shovel 18, a curved up tail 22, a top 26, a bottom 30, a core 34 and first 38 and second 42 sides are provided. The core 34 is located between the top 26 and the bottom 30. The shovel 18 and the tail 22 each have an end 46, 50, an inner side 54, 58 and an outer side 62, 66. The first side 38 extends from the inner side 54 of the shovel 18 to the inner side 58 of the tail 22. The second side 42 extends from the outer side 62 of the shovel 18 to the outer side 66 of the tail 22.

The core 34 is formed of resilient material 70 capable of providing rigidity to the snowboard 10 and securing mounting of a snowboard boot binding 74. An edge 78 is provided. The edge 78 is formed as a substantially right angle 82 at an intersection 86 of the bottom 30 and each of the front shovel 18, first 38 and second 42 sides, and the tail 22.

A variant of the invention further includes first 90 and second 94 sidecuts. The first sidecut 90 is formed as an inward deflection 98 of the first side 38 from a line 102 extending from the inner side 54 of the shovel 18 to the inner side 58 of the tail 22. The second sidecut 94 is formed as an inward deflection 106 of the second side 42 from a line 110 extending from the outer side 62 of the shovel 18 to the outer side 66 of the tail 22.

In another variant of the invention, the inward deflection 98 of the first sidecut 90 is in the range of 0.125 inches to 0.25 inches and the inward deflection 106 of the second sidecut 94 is in the range of 0.125 inches to 0.25 inches.

In still another variant, a displacement 114 of the end 46 of the shovel 18 above the top 26 of the snowboard 10 is in the range of one inch to four inches and a displacement 118 of the end 50 of the tail 22 above the top 26 of the snowboard 10 is in the range of one inch to four inches.

In yet another variant of the invention, the edge 78 further includes inset, resilient, hardened material 118 surrounding a perimeter 122 of the snowboard 10 adjacent the bottom 30. The inset material 118 is capable of being sharpened and holding an edge.

In still a further variant, the edge 78 is segmented at predetermined intervals 126 to provide increased flexibility of the snowboard 10. In yet a further variant of the invention, low-friction base material 130 is attached to the bottom 30 of the snowboard 10 within an inner perimeter 134 of the inset edge material 118.

In a final variant of the invention, the low-friction base material 130 is selected from the group containing: urethane plastic, polyurethane and ABS.

The improved individual snowboard for each foot 10 has been described with reference to particular embodiments. Other modifications and enhancements can be made without departing from the spirit and scope of the claims that follow.

What is claimed is:

1. An improved individual snowboard for each foot, comprising:

a curved up front shovel, a curved up tail, a top, a bottom, a core disposed between said top and said bottom, and first and second sides;

said shovel and said tail each having an end, an inner side and an outer side;

a displacement of the end of the shovel above the top of the snowboard being equal to a displacement of the end of the tail above the top of the snowboard;

said first side extending from the inner side of the shovel to the inner side of the tail;

said second side extending from the outer side of the shovel to the outer side of the tail;

said core being formed of resilient material capable of providing rigidity to the snowboard and securing mounting of a snowboard boot binding;

a snowboard boot binding, said binding being mounted at an angle to a long axis of the snowboard;

each of said snowboards being between 13 inches and 17 inches in length; and an edge, said edge being formed as a substantially right angle at an intersection of the bottom and each of the front shovel, first and second sides, and the tail.

2. An improved individual snowboard for each foot as described in claim 1, further comprising:

first and second sidecuts;

said first sidecut being formed as an inward deflection of the first side from a line extending from the inner side of the shovel to the inner side of the tail; and said second sidecut being formed as an inward deflection of the second side from a line extending from the outer side of the shovel to the outer side of the tail.

3. An improved individual snowboard for each foot as described in claim 2, wherein:

the inward deflection of the first sidecut is in the range of 0.125 inches to 0.25 inches; and the inward deflection of the second sidecut is in the range of 0.125 inches to 0.25 inches.

4. An improved individual snowboard for each foot as described in claim 1, wherein:

a displacement of the end of the shovel above the top of the snowboard is in the range of one inch to four inches; and a displacement of the end of the tail above the top of the snowboard is in the range of one inch to four inches.

5. An improved individual snowboard for each foot as described in claim 1, wherein the edge further comprises inset, resilient, hardened material surrounding a perimeter of the snowboard adjacent the bottom, said inset material capable of being sharpened and holding an edge.

6. An improved individual snowboard for each foot as described in claim 5, wherein the edge is segmented at predetermined intervals to provide increased flexibility of the snowboard.

7. An improved individual snowboard for each foot as described in claim 5, further comprising:

low-friction base material disposed upon the bottom of the snowboard within an inner perimeter of the inset edge material.

8. An improved individual snowboard for each foot as described in claim 7 wherein the low-friction base material is selected from the group containing: urethane plastic, polyurethane and ABS.

* * * * *